United States Patent [19]

Ryan et al.

[11] 4,157,934

[45] Jun. 12, 1979

[54] LOW TENSION LAP SLICER UNIT

[75] Inventors: Ralph L. Ryan, East Hanover; Charles M. Taitel, Parsippany, both of N.J.

[73] Assignee: Compensating Tension Controls, Inc., West Caldwell, N.J.

[21] Appl. No.: 816,282

[22] Filed: Jul. 18, 1977

[51] Int. Cl.[2] ..... B65H 19/18; B65H 19/20

[52] U.S. Cl. ..... 156/504; 156/505; 242/58.3; 242/58.5

[58] Field of Search ..... 156/505, 504, 544, 518, 156/157, 159, 502; 242/58.1, 58.3, 58.4, 58.5, 58.2

[56] References Cited

U.S. PATENT DOCUMENTS

| | | | |
|---|---|---|---|
| Re. 29,365 | 8/1977 | Butler, Jr. | 156/504 X |
| 3,489,628 | 1/1970 | Catzen | 156/504 |
| 3,580,757 | 5/1971 | Niepmann | 156/504 |
| 3,880,698 | 4/1975 | Kawazura et al. | 156/504 |
| 3,939,032 | 2/1976 | Taitel et al. | 156/518 X |
| 3,995,791 | 12/1976 | Schoppee | 156/505 X |

*Primary Examiner*—Michael G. Wityshyn
*Attorney, Agent, or Firm*—Gerald Durstewitz

[57] ABSTRACT

The splicer successfully lap splices web material being drawn from a roll under low tension. A central stationary knife member extends transversely of the web and splicing carriages on either side of the stationary knife are slideably mounted to be moved perpendicular to the web toward and away from the knife member. Each carriage includes a roller for directing the web past the splicing mechanism, a knife blade for cooperating with the knife member to cut the web, a clamping pad for engaging the side of the knife member for clamping web therebetween during a splice, and a pressure pad for impacting against the pad of the other carriage to press the webs to opposite sides of a strip of adhesive tape to form the splice.

7 Claims, 6 Drawing Figures

Fig. 1
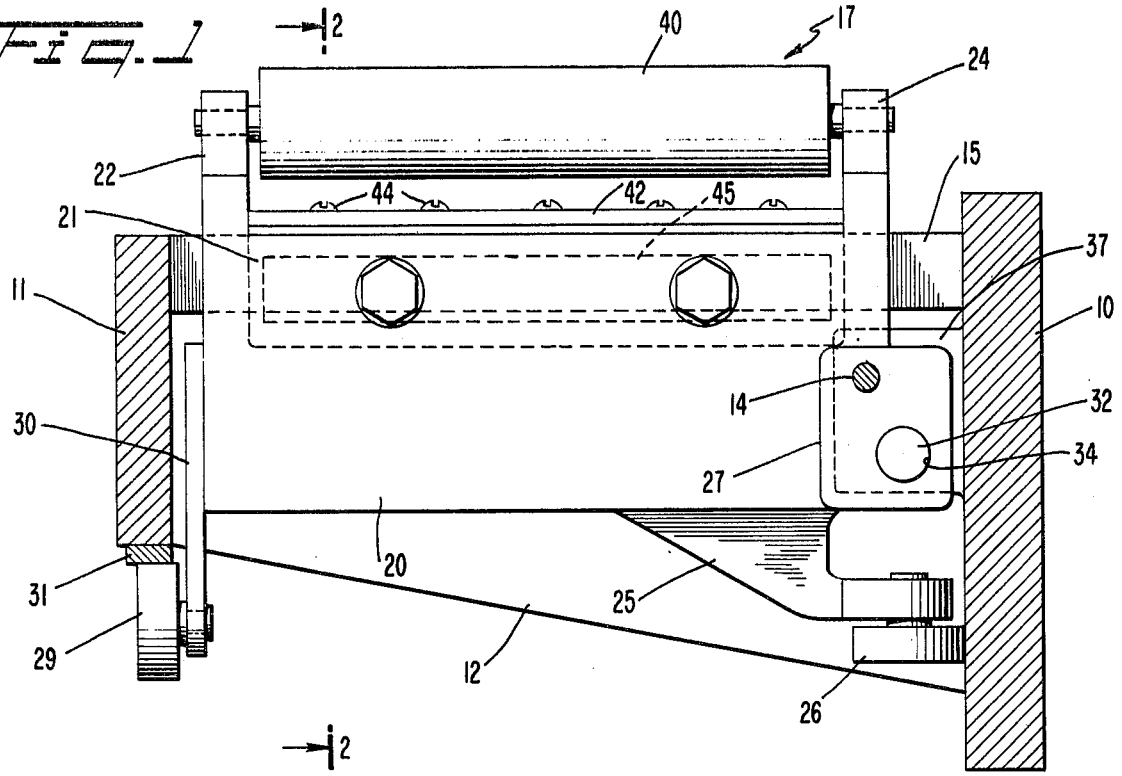
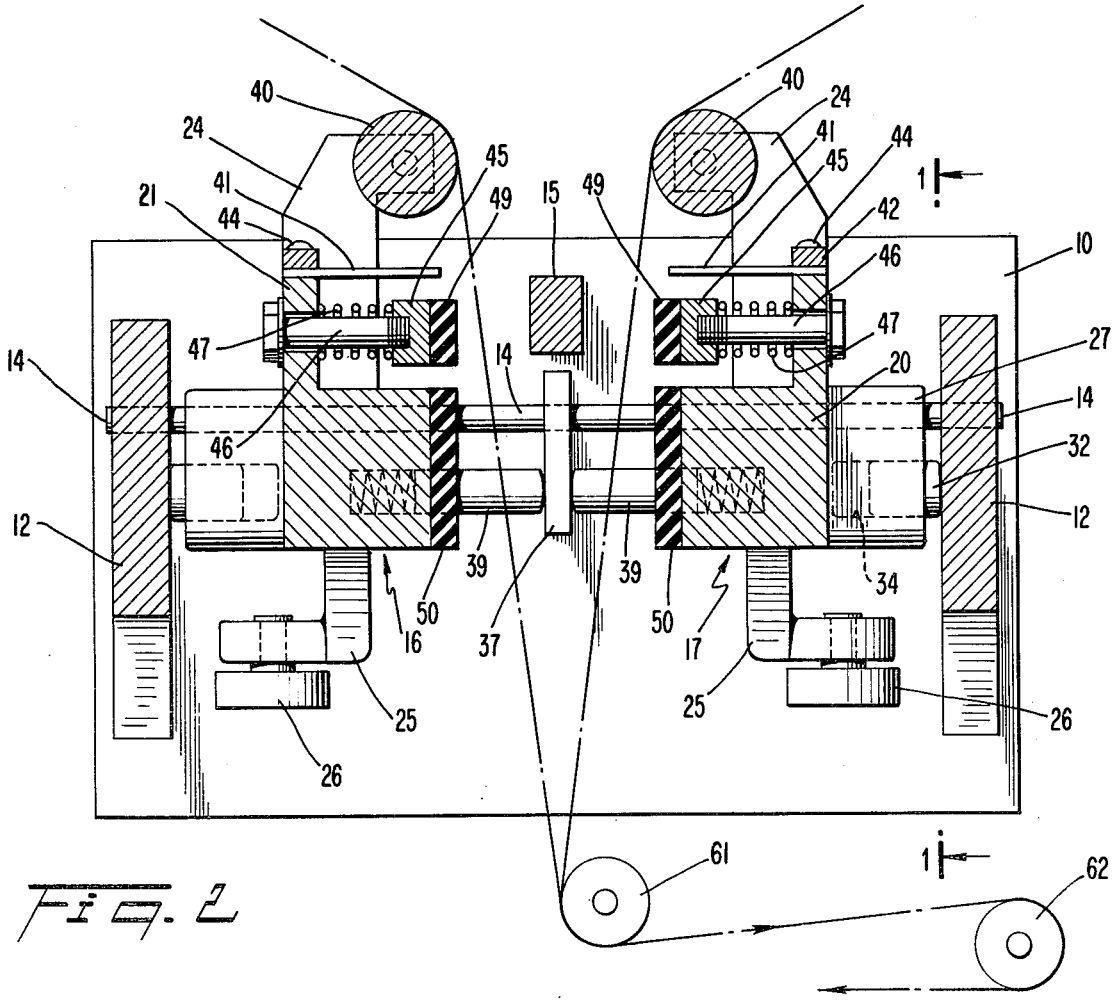
Fig. 2

LOW TENSION LAP SLICER UNIT

BACKGROUND OF THE INVENTION

The present invention relates to web splicing apparatus, and, more particularly, to such apparatus which lap splices the leading end of a full roll of web onto the web drawn from a depleting roll of web by a web utilizing device.

BACKGROUND OF THE INVENTION

The present invention relates to web splicing apparatus, and, more particularly, to such apparatus which lap splices the leading end of a full roll of web onto the web drawn from a depleting roll of web.

Web splicers are conventionally used to provide a continuous supply of web by overcoming the interruption resulting from the depletion of a supply roll. Such splicers normally include a splicing unit, a festoon, and spindles for holding the roll of web in use and a spare roll. A predetermined tension is maintained in the web by an adjustable braking arrangement connected to the spindles on which the rolls of web are mounted. The festoon includes a moveable carriage which is biased against the web tension by a compressed air cylinder. As the diameter of the supply roll decreases when web is drawn therefrom, the braking action applied to the roll to maintain a desired tension must be gradually decreased. In lap splicers, the splicing unit conventionally includes a pair of nip rollers. The nip rollers are normally spaced apart and the web extends from the roll in use past a cutting station and between the spaced nip rollers. The end of the web on the spare roll is positioned between the spaced nip rolls and a piece of double faced pressure sensitive tape is at the end of the web on the surface facing the running web. To splice the two webs, the nip rolls are brought together to press the tape against the running web, the running web is severed and the tension on the web rotates the nip rollers as the spliced section moves between the nip rollers as the splice is made. The festoon acts as a web storage unit to supply web to the using machinery during the splicing operation and while the new roll accelerates to line speed.

Where the web utilizing machinery requires that the web be supplied at very low tension (for example ½ pound total web tension), it is difficult to provide an effective splice. The web tension required just to rotate a pair of nip rollers which are pressing against each other with sufficient pressure to produce an effective splice is normally in excess of the low tension requirements of certain web utilizing machinery. In addition to rotating the nip rollers, the tension in the web must also overcome any rolling and sliding friction present in the rollers and guide members which direct the web along its path.

SUMMARY OF THE INVENTION

In view of the foregoing, it is an object of the present invention to provide an improved splicer for web materials.

Another object is to provide a lap splicer which requires minimum tension in the web being spliced.

Another object is to provide a lap splicer which consistently produces smooth and secure spliced webs under low tension.

Another object is to provide such a lap splicer which is simple and easy to operate.

The foregoing objects are accomplished by providing a splicer including a stationary knife member extending transversely of the web and a pair of carriages mounted on opposite sides of the knife member to be moveable toward and away from the knife member. The carriages include a knife blade which cooperates with an edge of the knife member to cut the web in use, a clamping pad to hold the end of the spare web in position during the splice, and a pressure pad to press the web ends together to form the splice.

BRIEF DESCRIPTION OF THE DRAWINGS

A preferred embodiment of the invention has been chosen for the purposes of illustration and description and is shown in the accompanying drawings forming a part of the specification wherein:

FIG. 1 is a side elevation of a lap splicer in accordance with the present invention, the view being a section taken along the line 1—1 on FIG. 2.

FIG. 2 is a front elevation of the splicer shown in FIG. 1, the view being a section taken along the line 2—2 on FIG. 1.

DESCRIPTION OF THE PREFERRED EMBODIMENT

Figure 3:
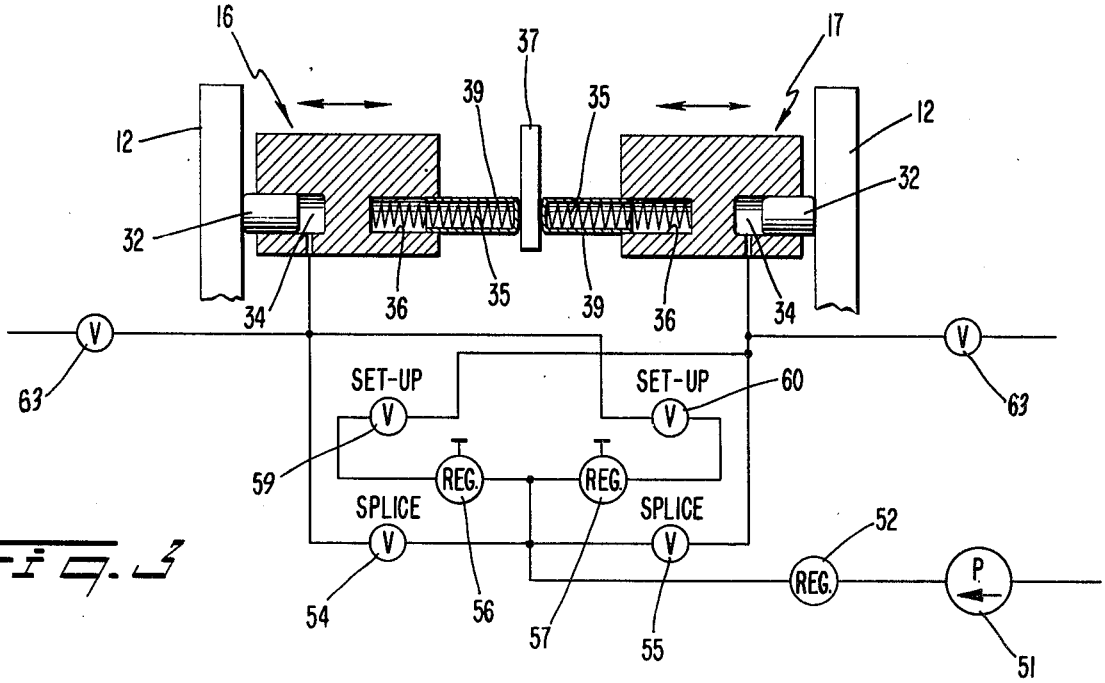
FIG. 3 is a schematic of the pneumatic system for operating the splicer.

Referring to the drawings in detail, there is shown a lap splicer unit in accordance with the present invention which generally comprises a vertical rear frame plate 10, a front plate 11, a pair of side frame members 12 extending from the plate 10 to the plate 11, a rod 14 extending between the members 12 parallel to the plate 10, a knife bar 15 extending from the top center of the plate 10 parallel with the side frame members 12 to the plate 11, and a pair of splicing carriages 16, 17 slideably mounted on the rod 14 on each side of the knife bar 15.

The splicing carriages each include an elongated body portion 20 of rectangular cross section, an elongated vertical bar portion 21 extending from the upper corner of the body portion nearest to the adjacent side frame member 12, a roller support arm 22 and 24 extending upwardly at each end of the body 20, a support leg 25 extending downwardly from the body, a wheel 26 carried by the support leg, and a piston housing 27 extending from the body 20 toward the adjacent side frame member 12.

The wheels 26 ride on the rear frame plate 10 and hold the carriages against rotation about the rod 14. A second wheel 29 is mounted to the end of the body 20 adjacent the front plate 11 by means of an arm 30. The wheels 29 extend under the plate 11 and engage a track strip 31 carried thereby to prevent the carriages from rotating upwardly about the rod 14 in response to the forces created by the shearing action of the two blades.

Each of the carriages is moved along the rod 14 away from the side frame members 12 by a piston 32 seated in a cylinder bore 34 within the housing 27. As shown in FIG. 3, a pneumatic system, described hereinafter in detail, selectively directs pressurized air into each cylinder bores 34 at the proper time to extend the pistons 32 and move the carriages toward the knife bar 15. The carriages are returned by springs 35 positioned in bores 36 and acting against a central support block 37 fo the rod 14. The support block 37 is mounted on the plate 10 and the rod 14 extends through a tight fitting bore in the block. Cup shaped pusher members 39 are positioned over the springs 35 to insure smooth operation.

On each splicing carriage, a roller 40 is mounted between the support arms 22 and 24. Below the roller 40 a knife blade 41 is mounted on the top of the vertical bar 21 by means of a metal strip 42 and screws 44 which extend into threaded bores in the bar 21. The bottom surface of the blade 41 is aligned with the top surface of the knife bar 15.

A web clamping bar 45 is retractably mounted to the vertical bar 21 by means of a pair of studs 46 which extend freely through holes in the bar 21 and are screwed into threaded holes in the bar. A helical spring 47 is positioned on each stud to bias the bars in an extended position. A resilient clamping pad 49 is attached to the surface of the bar to clamp web against the vertical side surfaces of the knife bar 15. The body portion 20 is provided with a resilient pressure pad 50 for pressing the two webs being spliced against a strip of tape positioned between them as described in detail hereinafter.

As shown in FIG. 3, the pneumatic system of the splicer is provided with pressurized air by an air pump 51 and a main pressure regulator 52. A pair of splice valves 54 and 55 deliver high pressure regulated air form the output of the regulator 52 to the cylinder bores 34. A pair of adjustable pressure regulators 56 and 57 are also connected to the output of the regulator 52 for supplying low pressure air to the cylinder bores 34 through "setup" valves 59 and 60. The valves 59 and 60 are physically positioned with the "splice" valves 54 and 55 respectively. The valves 59 and 54 are connected to opposite bores 34. Likewise, the valves 60 and 55 are connected to opposite bores. As described in detail hereinafter, the valves 59 and 54 are operated in sequence to form a splice under one condition and the valves 60 and 55 are operated in sequence to form a splice under a second condition.

Figure 4:
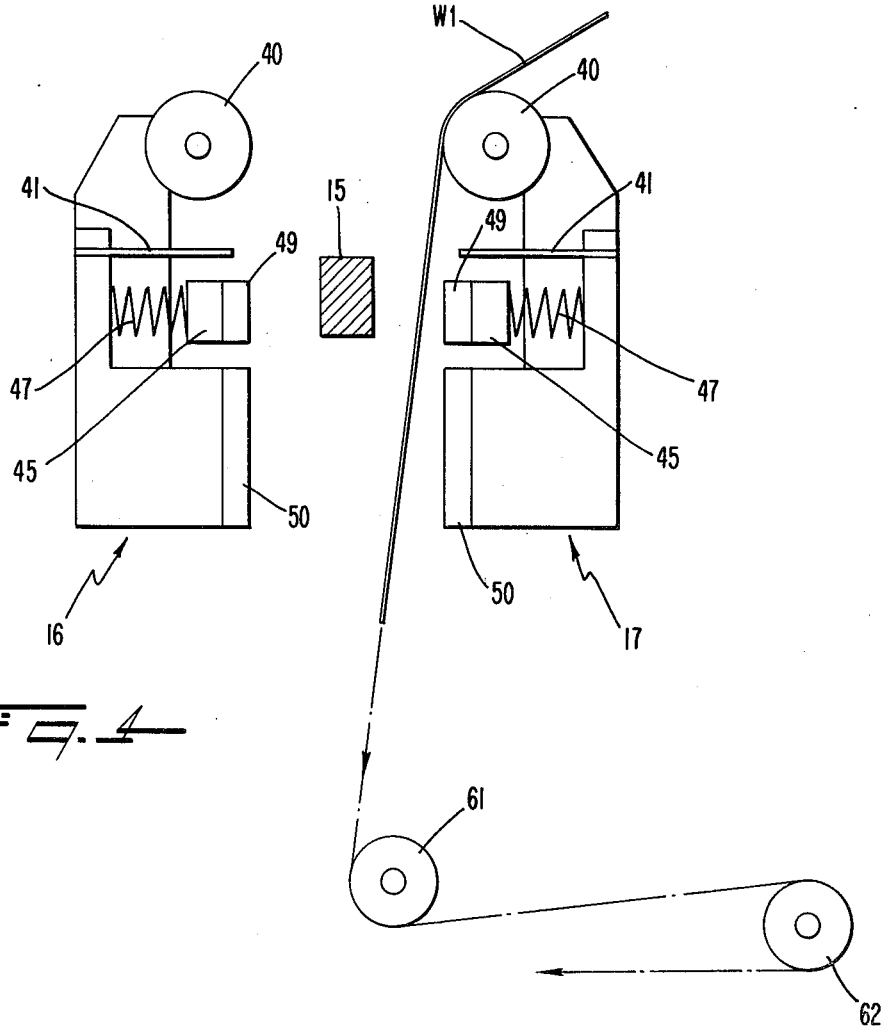
FIG. 4 is a schematic representation of the splicer in its unoperated condition.
Figure 5:
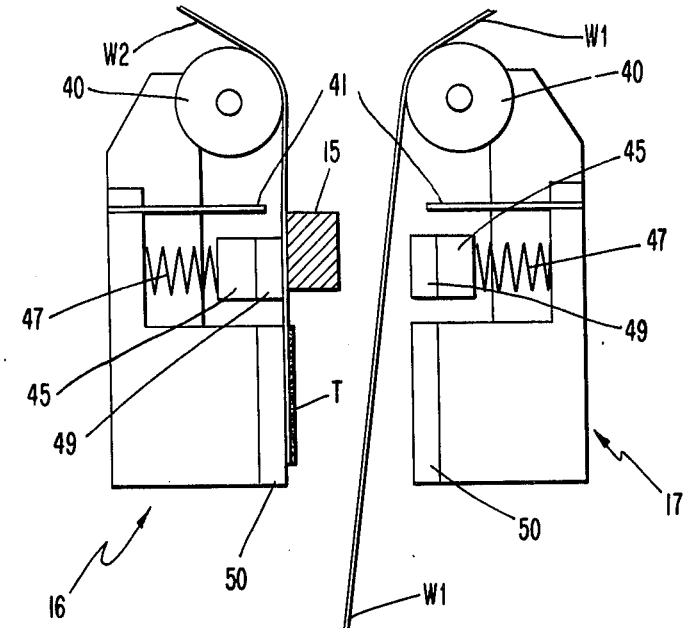
FIG. 5 is a schematic representation of the splicer in the setup condition wherein it has been prepared to initiate a splice.
Figure 6:
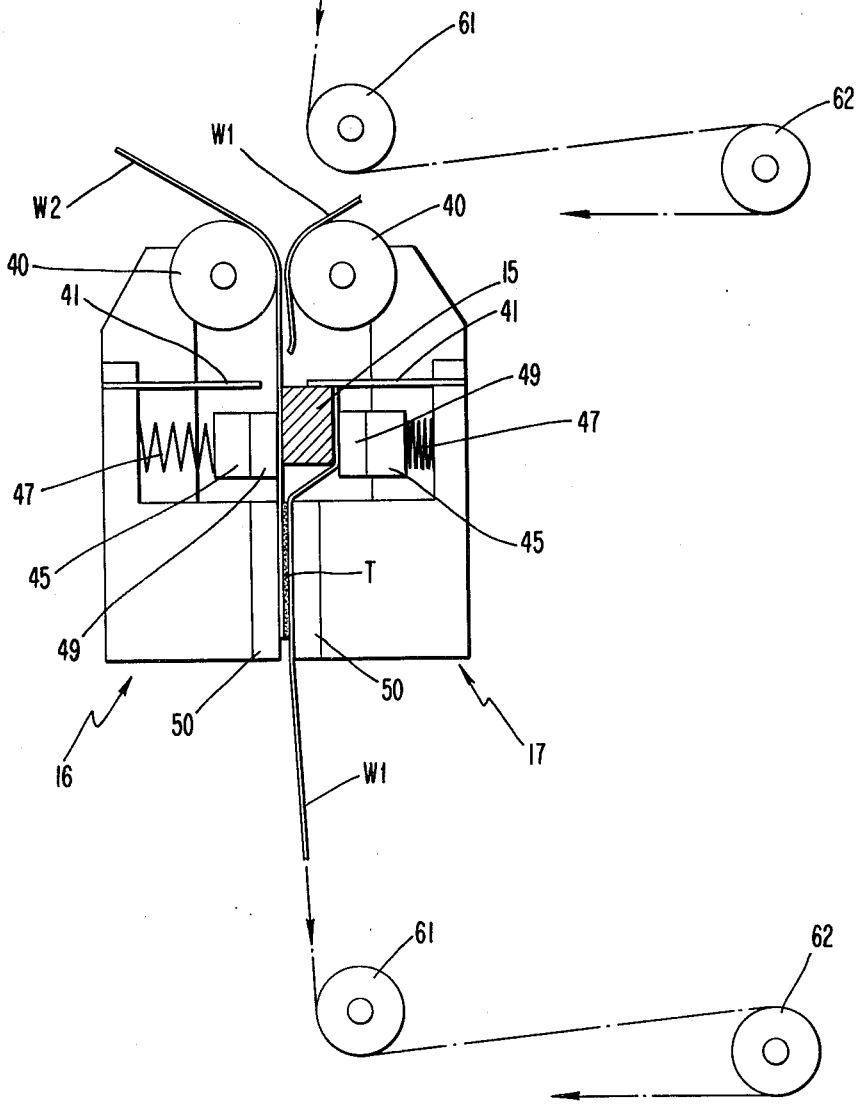
FIG. 6 is a schematic representation of the splicer in its operated condition wherein the splice is formed.

The operation of the present invention is best understood by referring to FIGS. 4 to 6. FIG. 4 shows the condition of the apparatus before a splicing sequence is initiated. The running web W1 is being drawn from a supply roll (not shown) downward over the roll 40 of the carriage 17, and between the knife bar 15 and the carriage to a roller 61. The web then runs around another roller 62 and passes through a web storage festoon (not shown) to the web utilizing mechanism. The festoon arrangement and the arrangement of the supply web roll and the spare web roll are conventional and may be that shown in U.S. Pat. No. 3,886,031. The web, in its run from the roller 40 to the roller 61, does not contact any of the elements of the splicing apparatus.

To ready or set up the apparatus for a splicing operation, the end of a spare roll of web W2 is lead over the roll 40 of the carriage 16 and is brought down to pad 50 of that carriage. A piece of double face pressure sensitive tape T is pressed to the end of the web W2 and the setup valve 60 is operated to introduce low pressure air into the cylinder bore 34 of the carriage 16. The carriage 16 moves to the right, to the position shown in FIG. 5, clamping the web W2 between the clamping pad 49 and the knife bar 15. The force generated n the piston 32 by the low pressure air is not sufficient to compress the springs 47.

The splice can now be made by operating the splice valve 55. This valve may be manually operated or it may be automatically operated by a device which senses that the supply roll has been depleted to a predetermined diameter.

The valve 55 directs high pressure air into the cylinder bore 34 of the carriage 17. As the carriage 17 is driven to the left, the clamp pad 49 clamps the web W1 to the knife bar 15, the knife blade 41 cuts the web W1, and the pressure pad 50 forces the tail end of the web W1 against the pressure sensitive tape as shown in FIG. 6. The cylinder bores 34 are then both vented by vent valves 63 automatically operated in any convenient manner and the springs 35 return the apparatus to the condition shown in FIG. 2 with the running web feeding over the roller 40 of the carriage 16.

When the web roll supplying web W2 nears depletion, the end of a new roll of web W1 will be brought over the roller 40 of the carriage 17, provided with a strip of tape, and then clamped in place by operating the setup valve 59. In this case, the splice will be accomplished by operating the valve 54.

It will be seen from the foregoing that the present invention provides an improved splicer for web materials which requires a minimum tension in the web being spliced, produces smooth and secure splices, and is simple and easy to operate.

We claim:

1. A splicer for lap splicing end of a supply web onto a depleting running web including in combination stationary bar means extending transversely of the web and providing knife edges at its upper end, first and second carriages mounted on opposite sides of said bar means to be moveable toward and away from said bar means, each of said carriages carrying a knife member rigidly mounted thereon for cooperating with one of said knife edges to cut the running web, a clamping pad positioned below said knife member, spring means for biasing said pad in the extended position, pressure pad means below said bar means, means for moving one of said carriages prior to a splice from a retracted position to a first operated position wherein said knife member is spaced from said knife edges and said clamping pad is pressed against said stationary bar means to hold the end of the supply web aligned with the pressure pad thereof, and means for moving the other of said carriages from a retracted position to a second operated position wherein said knife member thereof moves past one of said knife edges to sever the running web and said pressure pad thereof impacts against the pressure pad of the first carriage to force the running web against a strip of double face tape applied to the end of the supply web to thereby splice the webs.

2. Apparatus according to claim 1 wherein said means for moving said carriages toward said stationary bar means includes a fluid pressure actuator for moving each carriage, sources of relatively high and low pressure fluid medium, an means for selectively connecting said actuators to said high and low pressure fluid medium sources.

3. Apparatus according to claim 5 including first and second web directing rollers mounted on said first and second carriages respectively and positioned above and on each side of said stationary bar means a third web directing roller positioned below and in alignment with said bar means, said rollers being positioned to provide web paths from said first and second rollers to said third roller which paths are straight and unobstructed when said carriages are in their retracted position, a flat upright first frame member, a pair of spaced side second frame members extending from said first frame member, a single rod extending between said second frame members, said carriages being slideably mounted on said rod, and spring members for individually moving said carriages along said rod toward said frame members.

4. Apparatus according to claim 2 wherein said spring means for moving said carriages along said rod toward said second frame members are carried by said carriages and act against said stationary bar means, and said fluid actuators are carried by said carriages and act against said second frame members.

5. Apparatus according to claim 6 wherein said rod extends through said carriages at the edge thereof adjacent to said first frame member said carriages are provided with a support member engaging the face of said first frame member for preventing rotation of the carriage about said rod, and said fluid actuators and said spring members are positioned on the carriages adjacent to said rod.

6. Apparatus according to claim 5 wherein said side second frame members extend outwardly from said first frame member past said carriages and a third frame plate member parallel to said first frame member extends between the ends of said second frame members to enclose said carriages in a box like frame structure open at the top and bottom.

7. Apparatus according to claim 6 including a second support member mounted on each carriage and engaging a surface of said third frame plate member to prevent all rotation of the carriage about the rod.

* * * * *